United States Patent [19]

Sardano et al.

[11] Patent Number: 4,988,087

[45] Date of Patent: Jan. 29, 1991

[54] SHEET STACKER

[75] Inventors: Peter A. Sardano, Fairport; David J. Fish, Webster; Gerard R. Sturnick, Rochester, all of N.Y.

[73] Assignee: Xerox Corporation, Stamford, Conn.

[21] Appl. No.: 375,077

[22] Filed: Jul. 3, 1989

[51] Int. Cl.[5] ..... B65H 29/22

[52] U.S. Cl. ..... 271/314; 271/220

[58] Field of Search ..... 271/314, 178, 220, 224

[56] References Cited

U.S. PATENT DOCUMENTS

| | | | |
|---|---|---|---|
| 3,523,687 | 8/1970 | Petersen | 271/314 X |
| 3,815,899 | 6/1974 | Hatzmann | 271/314 |
| 4,056,264 | 11/1977 | Dhooge et al. | 271/177 |
| 4,330,116 | 5/1982 | Newsome | 271/178 |
| 4,428,574 | 1/1984 | Kataoka | 271/307 |
| 4,431,177 | 2/1984 | Beery et al. | 271/186 |
| 4,589,654 | 5/1986 | Kanoto | 271/314 |
| 4,767,114 | 8/1988 | Nishimoto | 271/314 X |
| 4,824,091 | 4/1989 | Knight | 271/178 |

FOREIGN PATENT DOCUMENTS

| | | | |
|---|---|---|---|
| 12453 | 1/1985 | Japan | 271/314 |

*Primary Examiner*—Richard A. Schacher

[57] ABSTRACT

A sheet stacker and an automatic printing machine containing a sheet stacker are provided comprising a generally horizontal stacking platform having an outboard and an inboard end, an arcuate turn baffle at the inboard end of the platform for guiding and turning sheets onto the platform having a convex side forming a drive nip with a sheet drive assembly comprising a rotatable dirve shaft having fixedly mounted thereto as least one cylindrical, compressible foam drive roll and least two cylindrical fiber brushes, the diameter of the fiber brushes being greater than the diameter of the foam drive rolls whereby the brushes when rotated urge the lead edge of a sheet being fed generally vertically downward toward the nip formed between the foam rolls and the baffle to enable the foam rolls to actively drive the sheet through the nip around the turn baffle onto the support platform toward the outboard end.

24 Claims, 5 Drawing Sheets

SHEET STACKER

CROSS REFERENCE TO RELATED APPLICATION

Attention is hereby directed to our U.S. patent application Ser. No. 07/375,180 entitled "Rotating Brush Decision Gate" filed concurrently herewith.

BACKGROUND OF THE INVENTION

The present invention relates to a sheet stacker and more particularly a sheet stacker for use with electrostatographic reproducing apparatus.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle. Alternatively, the electrostatic latent image may be generated from information electronically stored or generated in digital form which afterwards may be converted to alphanumeric images by image generation, electronics and optics. In such a printer application a beam of light such as a laser beam may be used to selectively discharge the photoconductor.

The geometry of the processing component in many automatic reproducing machines is such that the copies produced have the image on the top side and sequential copies enter the collecting tray with the copy or image side up. This is satisfactory if only a single copy of a single image is desired or multiple copies of a single image is desired. In both cases no distinction between sequential copies is required and all copies may be readily collected with the image side up. It is also satisfactory if the original documents fed to the copying machine are fed in reverse order, last or bottom sheet first and first or top sheet last. In this instance, the collected set has the top sheet face up on top and the bottom sheet face up on the bottom of the set. However, in most instances of copying sets of documents, the set is face up with top sheet on the top of the set and if copying according to normal procedures feeding the top document first, the top document number one, is copied producing a copy face up and set so produced has sheet number one face up on the bottom of the set and the last sheet face up on the top. In addition in electronic printing it is advantageous to be able to print from the first page to the last page in order since if you print from the last page to the first page the substance of the first to the last pages must be stored in the printers memory thereby increasing the size, cost and complexity of the memory required.

These difficulties may be avoided in the reproduction of successive sheets of a set by inverting each copy or print in the final set as it is collected face down with the top sheet on the bottom and the bottom sheet on the top. The Xerox 3700 copier and 2700 printers are examples of commercial applications of such inverters.

Typically, such inverters occupy a large amount of space which when accompanied with a high capacity stacker capable of stacking up to about 2,000 individual prints increases the overall machine volume required which when associated with the smaller low volume copiers and printers undesirably increases the size and thereby decreases customer acceptability.

PRIOR ART

U.S. Pat. No. 4,431,177 to Berry et al. describes a rotatable inverting and stacking wheel with at least one arcuate sheet retaining slot into which a sheet may be inserted such that its beam strength is increased, the wheel being incrementally rotated from the sheet load to unload position to strip the sheet from the slot, registering the leading edge of the sheet while simultaneously aligning or registering the side edge of the sheet. In addition, it has an offset registration member which is movable laterally with a directional component perpendicular to the direction of sheet transport to gently tap the edge of the sheet and offset and register it during its path of travel.

U.S. Pat. No. 4,428,574 Kataoka discloses a paper delivery apparatus including a rotating brush roller implanted with a plurality of circumferentially spaced apart bristle bundles.

SUMMARY OF THE INVENTION

In accordance with a principle aspect of the present invention, a sheet stacker and an automatic printing machine containing a sheet stacker are provided comprising a generally horizontal stacking platform having an outboard and inboard end, an arcuate turn baffle at the inboard end of the platform for guiding and turning sheets onto the platform and having a convex side forming a drive nip with a sheet drive assembly comprising a rotatable drive shaft having fixedly mounted thereto at least one cylindrical compressible foam drive roll and least two cylindrical fiber brushes, the diameter of the fiber brushes being greater than the diameter of the foam drive rolls whereby the brushes when rotated urge the lead edge of a sheet being fed generally vertically downward toward the nip formed between the foam rolls and the baffle to enable the foam rolls to actively drive the sheet through the nip around the turn baffle onto the support platform toward the outboard end.

In accordance with a further aspect of the present invention the rotatable foam roll and brushes are located relative to the stacking platform such that the angle of incidence of a sheet entering the stacking platform from the drive nip is less than about 40°.

In accordance with a further aspect of the present invention the turn baffle has at least one slot with at least one idler roll mounted on the concave side of the turn baffle therein forming a drive nip with the foam roll.

In accordance with a further aspect of the present invention the outboard end of the support platform has a registration edge and means to register successive sheets on said support platform against said edge.

In accordance with a further aspect of the present invention the means to register comprises two cylindrical registration fiber brushes which when rotated urge the top sheet on the support platform towards said registration edge.

In accordance with a further aspect of the present invention means are provided to rotate the registration brushes faster than the foam rolls.

In accordance with a further aspect of the present invention the sheet stacking platform is supported by and vertically movable by an elevator.

In accordance with a further aspect of the present invention the foam rolls comprise a low density, open celled polyurethane foam inner layer with a thin higher density closed cell polyurethane foam surface layer having a coefficient of friction with ordinary paper of at least about two.

In accordance with a further aspect of the present invention the brushes comprise a plurality of tufts of nylon filaments having a coefficient of friction with ordinary paper of less than about 0.3 mounted on a hub.

In accordance with a further aspect of the present invention the arcuate baffle, rotatable foam roll and brushes are so located relative to the stacking platform that the ends of the brushes are effective in capturing and holding down the trail edge of a sheet that has been stacked on the support platform.

In accordance with a further aspect of the present invention, two foam rolls form the driving nip with two idler rolls positioned in two slots in the turn baffle.

Other features of the present invention will become apparent as the following description proceeds and upon reference to the drawings.

DESCRIPTION OF THE PREFERRED EMBODIMENT

The invention will now be described with reference to a preferred embodiment of the sheet feeder with reversing drive mechanism in an electrostatographic printing apparatus.

Figure 1:
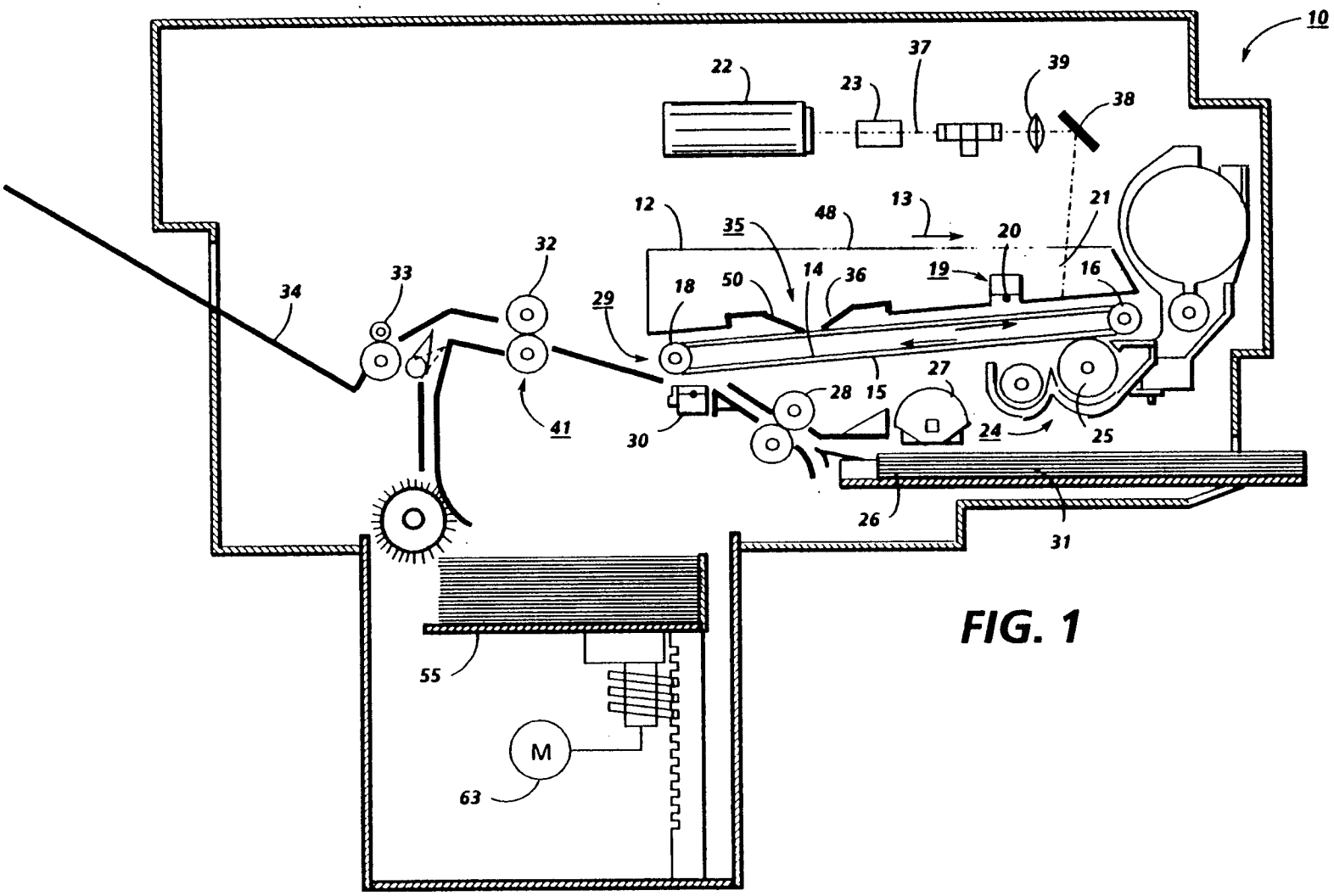
FIG. 1 is a schematic representation in cross section of an automatic electrostatographic printing machine which may employ the sheet stacker according to the present invention.

Referring now to FIG. 1, there is shown by way of example, an automatic electrostatographic printing machine 10 which includes a sheet stackeraccording to the present invention. The reproducing machine depicted in FIG. 1 illustrates the various components utilized therein for producing prints. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiment shown herein.

The printing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a print of information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to light from raster output scanner which includes a suitable source of high intensity light such as laser 22 modulated in accordance with the content of the image signals as by an acoustic-optic modulator 23 to provide an imaging beam 37. Beam 37 is scanned across photoreceptor 14 at exposure station 21 by a scanning polygon 38 to expose the previously charged photoreceptor and create a latent electrostatic image of the document represented by the image signals input to modulator 23. Suitable optical means such as lens 39 is provided to focus beam 37 on photoreceptor 14.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 wherein roll fuser 32 fixes the transferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within a cleaning housing which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

Figure 2:
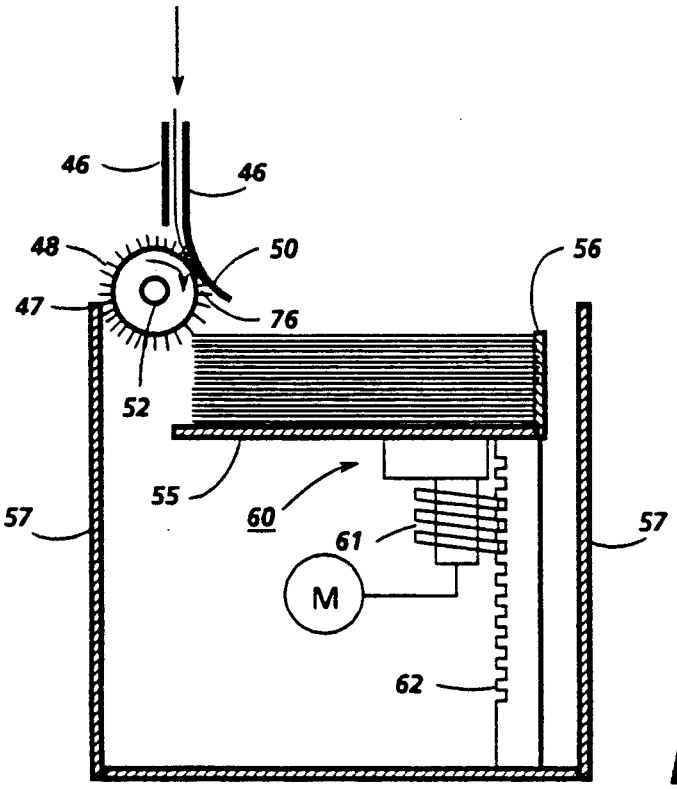
FIG. 2 is an enlarged cross sectional view of the stacker according to the present invention wherein an idler roll is contained within a slot in the turn baffle to form the drive nip with the foam drive roll.
Figure 4:
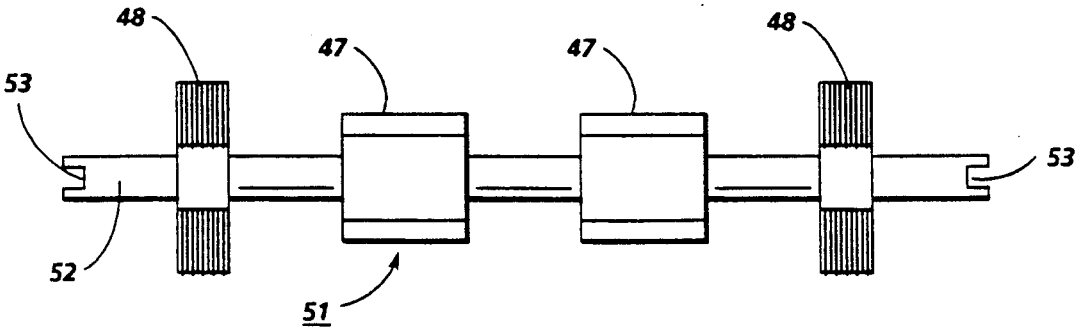
FIG. 4 is a sectional view of the rotatable foam roll brush assembly.
Figure 3A:
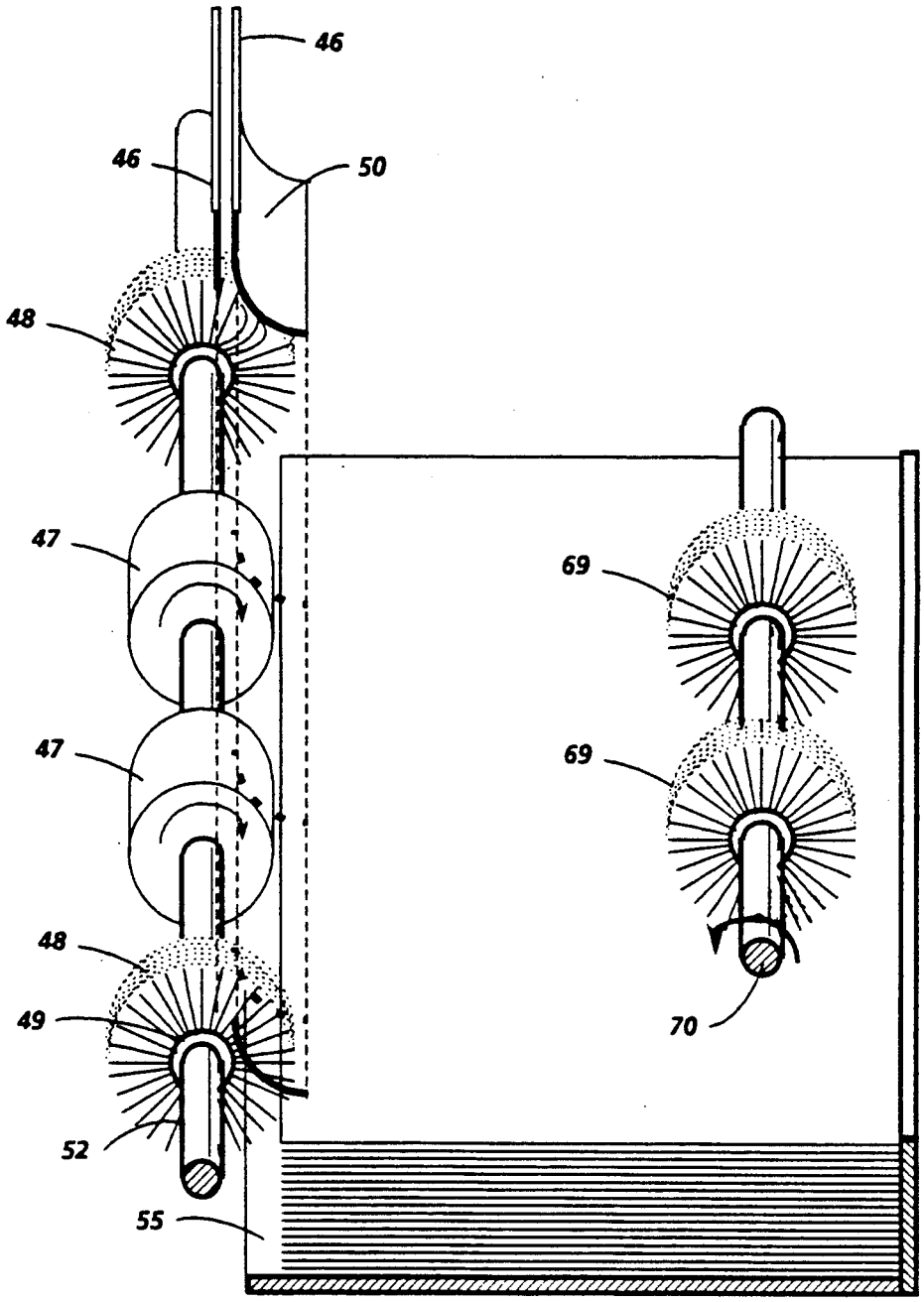
FIG. 3 and 3B are isometric views of the sheet stacker according to the present invention with the elevator support platform and registration brushes at the outboard end of the support platform.

With continued reference to FIG. 1 and additional reference to FIGS. 2 through 7, the sheet stacker, according to the present invention, will be described in greater detail. As illustrated in FIGS. 1, 2 and 3A and B, the sheet stacker comprises a vertically movable support platform 55 movable in the vertical guides 56 of frame 57. The height of the support platform 55 is adjusted by an elevator mechanism 60 comprising a motor 63 pinion 61 mounted to the underside of the support platform and a pinion rack 62 mounted to the frame 57 for engagement by the rack to move the support platform vertically within the vertical guides 56. To stack successive sheets from the printing apparatus, they are directed from the fuser 41 through output drive rolls 45 toward the sheet stacker and guided toward the drive nip by vertical guide baffle 46. The successive sheets are turned about 90° from the vertical to the generally horizontal stacking platform by passing through a drive nip between a turn baffle 50 and a sheet drive assembly 51 comprising a shaft 52 having at least one foam roll mounted thereon and cylindrical fiber brushes at each end of the foam roll 47. The diameter of the cylindrical fiber brushes 48 is greater than the diameter of the foam drive roll and while the foam drive roll forms drive nip 76, see FIG. 7, at its outer surface, the flexible fibers of the cylindrical fiber brush are deflected through the nip. Furthermore, since the vertical guide baffle 46 extends partially into the path of the tips of the individual fibers of the cylindrical fiber brush as the fibers rotate passed the brush, they tend to snap forward directing any sheet that may be in their path toward the nip formed between foam roll and the guide baffle. In this regard it is noted that the vertical guide baffle 46 is preferably slightly to the right of the axis of the sheet drive assembly as illustrated in FIG. 2 to ensure that any sheet being directed into the drive nip by the brush is deflected to the right rather than to the left. Thus, the brush takes a lead edge of a sheet guides it and drives it forwardly without forming a buckle from friction or any other stubbing forces. With this geometry the ends of the fibers strike the baffle and when released have a high velocities and force the sheet toward the turn baffle and down. Otherwise, sheets coming in might stub up against the brush forming a buckle and jam. The arcuate baffle rotatable foam roll and the brushes are so located relative to the stacking platform that the angle of stacking of incoming sheets or the angle of exit of the sheet from the nip in relation to the stacking platform has a angle of incidence of less than about 40°. Furthermore with this geometry the rotating brushes are affective in capturing and holding down the trail edge of a sheet that has been stacked in the support platform which enables the insertion of successive sheets onto the support platform without the lead edge of successive sheets running into the trail edge of the preceding sheet. With regard to the angle of incidence and the position of the support platform if the top of the stack of sheets on the support platform is too high the rotating brush may tend to pull sheets back out of the platform. On the other hand, if it is too low, there may be a difficulty with the angle of incidence which could cause the entering sheet to jam and/or roll over.

To ensure the proper level of the top of the stack of sheets on the support platform the elevator mechanism is equipped with a stack height switch (not shown) which indexes the support platform down as incoming sheets fill the support platform. Further there may be a lower limit switch which may be tripped when the sheet stacker has reached its capacity to alert the operator or turn the printing machine off. With the illustrated geometry, a compact stacking apparatus wherein sheets are driven actively around a small radius of the order of less than 50 millimeters is provided. In addition, with the drive nip being provided between an arcuate baffle and a foam roll and the sheets being initially urged toward the drive nip by a longer rotating fiber brush the ends of the brush can be used to maintain the trail edge of successive sheets at a held down position on the support platform. This has a particular advantage of being able to control the trail edge of sheets of two different paper widths and thereby obtaining offsetting of jobs of sheets of different paper widths without the necessity of adjusting the position of the stacking platform. Furthermore, by the presence of a brush in such a device, offsetting between jobs by moving the platform laterally may be readily maintained without the brush interfering with the position of the individual stacks.

Figure 6:
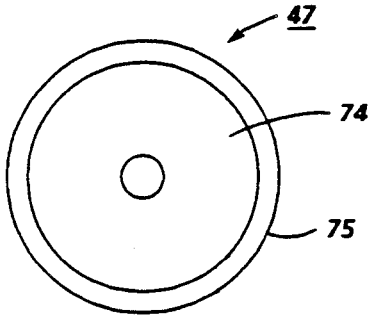
FIG. 6 illustrates the cross sectional structure of the foam roll.
Figure 7:
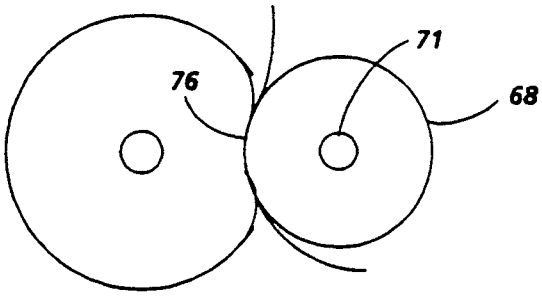
FIG. 7 illustrates compliant interaction between the foam and the hard idler roll or arcuate turn baffle.

The foam roll 47 may be made of any suitable material and of any suitable configuration. Typical configuration is illustrated in FIG. 6 wherein it comprises a low density, open celled foam inner layer 74 with a thin higher density closed cell foam surface layer 75. Typically, both the inner layer and surface layer are made from polyurethane foams with the inner layer being of order of 40 millimeters in diameter and the outer layer being of the order of 3 to 5 mils (convert to millimeters) thick. The thin foam surface layer may be formed by dip coating the open celled foam inner to provide a surface having coefficient of friction with ordinary paper of at least about 2. By ordinary paper it is intended to define regular bond papers and specifically includes Xerox 4024 paper and similar papers. As illustrated in FIG. 7, it is important that the foam roll be compressibly compliant to impart the entrance and exit geometry in the nip 76 between the foam roll and the turn baffle. To provide this compressibility, the open celled foam typically has a density of the order of 4 pounds per cubic foot. As a result of this compressibility and the geometry of the system, the foam roll is capable of providing an active drive to a sheet rather than a passive push system to direct and drive output sheets onto the support platform.

The brushes may be made of any suitable material which is conductive and does not create static electricity to any significant extent but rather tends to drain off any static electricity generated and which does not create defects in the image. The diameter and length of the brush fibers are selected to provide the stiffness of the brush to enable it to urge incoming sheets toward the drive nip and to hold down the trail edge of the sheets on support platform but not to stiff to act on the sheets stacked on the support platform as to tend to drive the sheets back off the support platform. Typically, the brushes are made of tufts of 6 mil nylon fibers which may be attached to the hub of the brush. In a typical configuration, 12 tufts of nylon fibers having a coefficient of friction with ordinary paper less than about 0.3 are mounted on a hub about 25 millimeters in diameter to provide a rotating brush about 75 millimeters in diameter.

Figure 3B:
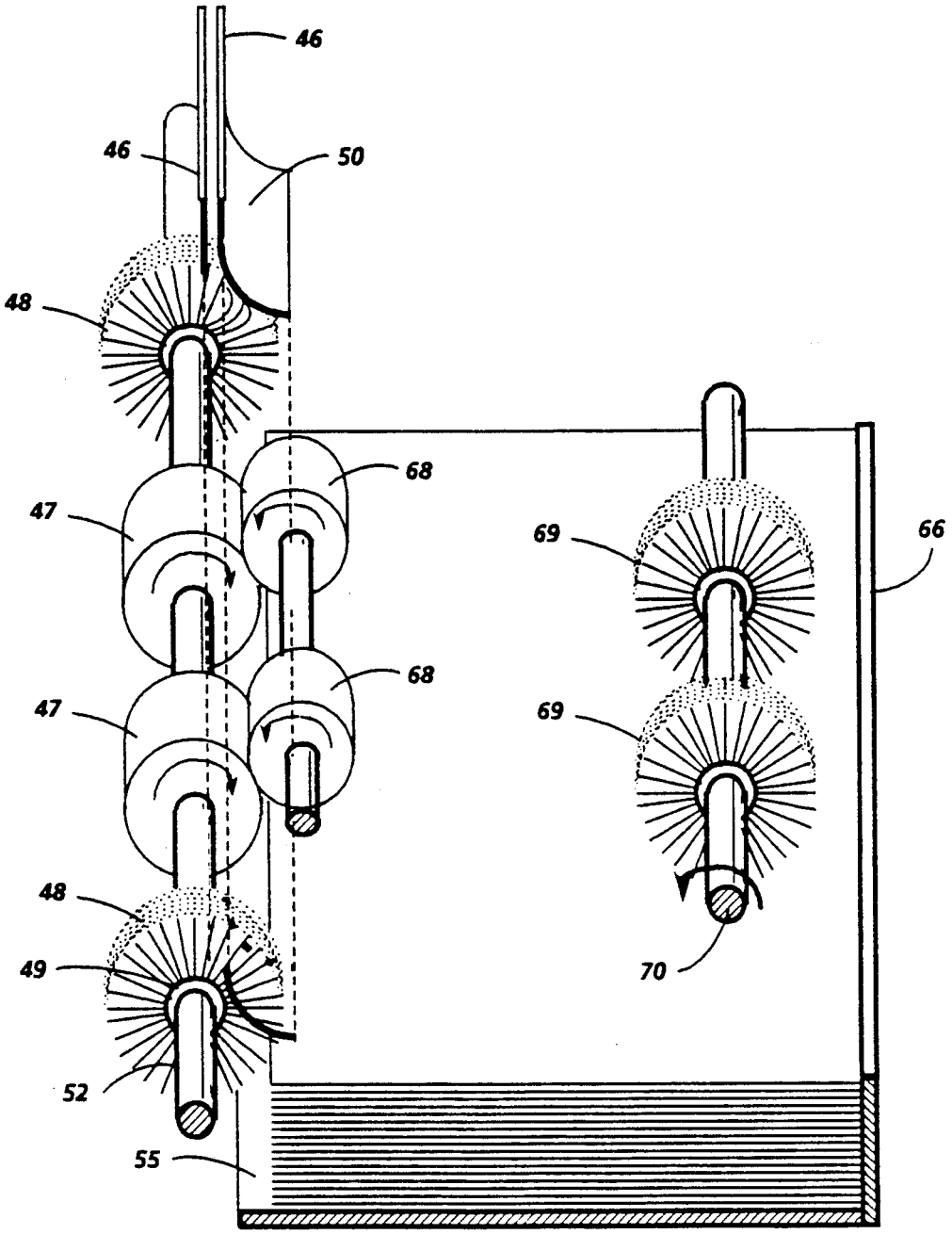
Figure 5:
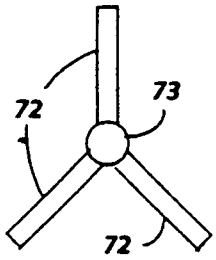
FIG. 5 is flipper finger or paddle alternative to the registration brush.

Attention is directed to FIGS. 3B and 5 wherein alternative embodiments of the present invention are illustrated. In FIG. 3B, the arcuate turn baffle 50 has two slots 67 each with an idler roll 68 mounted on the concave side of the turn baffle and extending through the baffle to be in contact with the foam drive rolls 47. The idler rolls are relatively hard compared to the foam rolls so that the foam roll is compliant with idler roll as illustrated in FIG. 7 thereby providing better control of the direction of the paper as it is steered through the drive nip 76. Also illustrated in FIGS. 3A and 3B at the outboard end of the stacking platform are two registration brushes 69 mounted on a rotatable brush shaft 70 which are used to urge incoming sheets onto the support platform 55 against registration edge 66 to register the lead edge of the sheets in any particular job. Typically, the registration brushes are rotated at speed faster than the foam roll and brush on the drive assembly to overcome sheet to sheet friction and to ensure that the sheets are pulled forward toward the registration without a buckle being formed therein which might inhibit the passage of successive sheets to the stacking platform. The registration brushes may if desired be constructed in the same manner and of the same materials as the brushes in the sheet drive assembly.

FIG. 5 illustrates an alternative registration device comprising a rotatable drive shaft 73 having at least one prong flipper finger 72 fixedly mounted thereto which may be rotated to urge sheets toward the registration edge 66. The registration member such as the brush or flipper fingers also serve the function of holding the lead edge of the stack of sheets being stacked in the sheet stacker down. This is of some significance with a large number, for example, 2000 sheets, in the sheet stacker since a substantial amount of space in the sheet stack may be taken with sheet curl formed when the individual sheets pass through the fuser to fuse the toner image.

Accordingly, the present invention provides a simple, compact and relatively inexpensive sheet stacking apparatus which is capable of high reliability and high volume stacking. It provides a unique method of inverting a sheet and stacking successive sheets to enable 1 to N printing in an electronic printer. By providing a sharp turning radius around which the individual sheets may be turned, a compact sheet stacker is provided. It further has the advantage in that offsetting of two different widths of paper is automatically accomplished without adjustment of the position of the stacking platform.

The disclosure of the publications referred to herein is hereby specifically and totally incorporated herein by reference.

While the invention has been described with reference to specific embodiments, it will be apparent to those skilled in the art that many alternatives, modifications and variations may be made. For example, while the invention has been illustrated in a printer embodiment wherein successive sheets are stacked in a stacker 1 to N with the image side face down, it may be used in an N to 1 copier application with the document feeder feeding from the bottom to provide N to 1 stacking with the face side up. Accordingly, it is intended to embrace all such alternatives, modifications as may fall within the spirit and scope of the appended claims.

What is claimed is:

1. A sheet stacker comprising a generally horizontal stacking platform having an inboard and an outboard end, an arcuate turn baffle at the inboard end of said platform for guiding and turning sheets onto said platform, said arcuate turn baffle having its convex side forming a drive nip with a sheet drive assembly comprising a rotatable drive shaft having fixedly mounted thereto at least one cylindrical compressible foam drive roll and at least two cylindrical fiber brushes one at each end of said at least one foam roll, the diameter of the fiber brushes being greater than the diameter of the foam drive roll whereby said fiber brushes when rotated urge the lead edge of a sheet being fed generally vertically downward toward the nip formed between the foam roll and said baffle to enable the foam rolls to actively drive the sheet through the nip around the turn baffle onto the support platform and toward the outboard end.

2. The sheet stacker of claim 1 wherein said turn baffle has at least one slot with an idler roll mounted on the concave side of the turn baffle therein forming a drive nip with said foam roll.

3. The sheet stacker of claim 1 further including a registration edge at the outboard end of said support platform and means to register successive sheets on said support platform against said nip.

4. The sheet stacker of claim 3 wherein said means to register comprises at least two cylindrical registration fiber brushes which when rotated urge the top sheet on the support platform toward said registration edge.

5. A sheet stacker comprising a generally horizontal stacking platform having an inboard and an outboard end, an arcuate turn baffle at the inboard end of said platform for guiding and turning sheets onto said platform, said arcuate turn baffle having its convex side forming a drive nip with a sheet drive assembly comprising a rotatable drive shaft having fixedly mounted thereto at least one cylindrical compressible foam drive roll and at least two cylindrical fiber brushes one at each end of said at least one foam roll, the diameter of the fiber brushes being greater than the diameter of the foam drive roll whereby said fiber brushes when rotated urge the lead edge of a sheet being fed generally vertically downward toward the nip formed between the foam roll and said baffle to enable the foam rolls to actively drive the sheet through the nip around the turn baffle onto the support platform and toward a registration edge at the outboard end of said support platform, at least two cylindrical registration fiber brushes which when rotated urge the top sheet on the support platform toward said registration edge, and including means to rotate said registration brushes faster than said foam roll.

6. The sheet stacker of claim 3 wherein said means to register comprises a drive shaft having at least one pronged flipper finger fixedly mounted thereto.

7. The sheet stacker of claim 1 wherein said stacking platform is supported by and vertically movable by an elevator.

8. The sheet stacker of claim 1 wherein said at least one foam roll comprises a low density open celled polyurethane foam inner layer with a thin higher density closed cell polyurethane foam surface layer having a coefficient of friction with ordinary paper of at least about 2.

9. The sheet stacker of claim 1 wherein said brushes comprise a plurality of tufts of nylon filaments having a coefficient of friction with ordinary paper of less than about 0.3 mounted on a hub.

10. The sheet stacker of claim 1 wherein said arcuate baffle, rotatable foam roll and brushes are so located relative to the stacking platform that the ends of the brushes are effective in capturing and holding down the trail edge of a sheet that has been stacked on the support platform.

11. The sheet stacker of claim 10 wherein the angle of incidence of a sheet entering the stacking platform from the drive nip is less than about 40°.

12. The sheet stacker of claim 2 wherein said at least one foam roll comprises two foam rolls and said turn baffle has two slots with idler rolls therein forming drive nips with said foam rolls.

13. A printing machine comprising means for forming a visible image on a sheet substrate and a sheet stacker for stacking successive sheets, said stacker comprising a generally horizontal stacking platform having an inboard and an outboard end, an arcuate turn baffle at the inboard end of said platform for guiding and turning sheets onto said platform, said arcuate turn baffle having its convex side forming a drive nip with a sheet drive assembly comprising a rotatable drive shaft having fixedly mounted thereto at least one cylindrical compressible foam drive roll and at least two cylindrical fiber brushes one at each end of said at least one foam roll, the diameter of the fiber brushes being greater than the diameter of the foam drive roll whereby said fiber brushes when rotated urge the lead edge of a sheet being fed generally vertically downward toward the nip formed between the foam roll and said baffle to enable the foam rolls to actively drive the sheet through the nip around the turn baffle onto the support platform and toward the outboard end.

14. The printing machine of claim 13 wherein said turn baffle has at least one slot with an idler roll mounted on the concave side of the turn baffle therein forming a drive nip with said foam roll.

15. The printing machine of claim 13 further including a registration edge at the outboard end of said support platform and means to register successive sheets on said support platform against said edge.

16. The printing machine of claim 15 wherein said means to register comprises at least two cylindrical registration fiber brushes which when rotated urge the top sheet on the support platform toward said registration edge.

17. A printing machine comprising means for forming a visible image on a sheet substrate and a sheet stacker for stacking successive sheets, said stacker comprising a generally horizontal stacking platform having an inboard and an outboard end, an arcuate turn baffle at the inboard end of said platform for guiding and turning sheets onto said platform, said arcuate turn baffle having its convex side forming a drive nip with a sheet drive assembly comprising a rotatable drive shaft having fixedly mounted thereto at least one cylindrical compressible foam drive roll and at least two cylindrical fiber brushes one at each end of said at least one foam roll, the diameter of the fiber brushes being greater than the diameter of the foam drive roll whereby said fiber brushes when rotated urge the lead edge of a sheet being fed generally vertically downward toward the nip formed between the foam rolls to actively drive the sheet through the nip around the turn baffle onto the support platform and toward a registration edge at the outboard end of said support platform, at least two cylindrical registration fiber brushes which when rotated urge the top sheet on the support platform toward said registration edge, and including means to rotate said registration brushes faster than said foam roll.

18. The printing machine of claim 15 wherein said means to register comprises a drive shaft having at least one pronged flipper finger fixedly mounted thereto.

19. The sheet stacker of claim 13 wherein said stacking platform is supported by and vertically movable by an elevator.

20. The printing machine of claim 13 wherein said at least one foam roll comprises a low density open celled poyurethane foam inner layer with a thin higher density closed cell polyurethane surface layer having a coefficient of friction with ordinary paper of at least about 2.

21. The printing machine of claim 13 wherein said brushes comprise a plurality of tufts of nylon filaments having a coefficient of friction with ordinary paper of less than about 0.3 mounted on a hub.

22. The sheet stacker of claim 13 wherein said arcuate baffle, rotatable foam roll and brushes are so located relative to the stacking platform that the ends of the brushes are effective in capturing and holding down the trail edge of a sheet that has been stacked on the support platform.

23. The sheet stacker of claim 22 wherein the angle of incidence of a sheet entering the stacking platform from the drive nip is less than about 40°.

24. The sheet stacker of claim 14 wherein said at least one foam roll comprises two foam rolls and said turn baffle has two slots with idler rolls therein forming drive nips with said foam rolls.

* * * * *